US009626917B2

(12) United States Patent
Kasegawa et al.

(10) Patent No.: US 9,626,917 B2
(45) Date of Patent: Apr. 18, 2017

(54) IMAGE DISPLAY APPARATUS, DRIVING METHOD OF IMAGE DISPLAY APPARATUS, SIGNAL GENERATION APPARATUS, SIGNAL GENERATION PROGRAM, AND SIGNAL GENERATION METHOD

(71) Applicant: Sony Corporation, Tokyo (JP)

(72) Inventors: Ryo Kasegawa, Kanagawa (JP); Akihito Nishiike, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 122 days.

(21) Appl. No.: 14/423,822

(22) PCT Filed: Aug. 9, 2013

(86) PCT No.: PCT/JP2013/071606

§ 371 (c)(1),
(2) Date: Feb. 25, 2015

(87) PCT Pub. No.: WO2014/038348

PCT Pub. Date: Mar. 13, 2014

(65) Prior Publication Data

US 2015/0228231 A1 Aug. 13, 2015

(30) Foreign Application Priority Data

Sep. 6, 2012 (JP) ..... 2012-195939

(51) Int. Cl.
*G09G 5/10* (2006.01)
*G09G 3/36* (2006.01)
*G09G 3/34* (2006.01)

(52) U.S. Cl.
CPC ..... *G09G 3/3607* (2013.01); *G09G 3/3413* (2013.01); *G09G 2300/0452* (2013.01);
(Continued)

(58) Field of Classification Search
None
See application file for complete search history.

(56) References Cited

U.S. PATENT DOCUMENTS

2009/0160747 A1* 6/2009 Morisue ..... G09G 3/3406 345/88
2014/0035962 A1* 2/2014 Izumi ..... G09G 3/30 345/690

FOREIGN PATENT DOCUMENTS

JP 05-241551 9/1993
JP 2001-147666 5/2001
(Continued)

*Primary Examiner* — Adam R Giesy
(74) *Attorney, Agent, or Firm* — Chip Law Group

(57) ABSTRACT

An image signal for red color display, an image signal for green color display, and an image signal for blue color display which correspond to a pixel are denoted as reference symbol $R_{nL}$, reference symbol $G_{nL}$, reference symbol $B_{nL}$, respectively, a minimum value thereof is denoted as $MinRGB_{nL}$, and a threshold defined as a predetermined value is denoted as reference symbol $TH_1$. In a case, where $MinRGB_{nL} \leq TH_1$ holds:

the value of the signal for the white color sub-pixel is $MinRGB_{nL}/TH_1$, the value of the signal for the red color sub-pixel is $R_{nL}-MinRGB_{nL}$, the value of the signal for the green color sub-pixel is $G_{nL}-MinRGB_{nL}$, and the value of the signal for the blue color sub-pixel is $B_{nL}-MinRGB_{nL}$.

In a case, where $MinRGB_{nL} > TH_1$ holds:

the value of the signal for the white color sub-pixel is 1, the value of the signal for the red color sub-pixel is $(R_{nL}-TH_1)/(1-TH_1)$, the value of the signal for the green color sub-pixel is $(G_{nL}-TH_1)/(1-TH_1)$, and (Continued)

the value of the signal for the blue color sub-pixel is $(B_{nL}-TH_1)/(1-TH_1)$.

8 Claims, 6 Drawing Sheets

(52) U.S. Cl.
CPC ..... *G09G 2310/027* (2013.01); *G09G 2320/0233* (2013.01); *G09G 2320/0626* (2013.01); *G09G 2320/0666* (2013.01); *G09G 2340/06* (2013.01); *G09G 2360/16* (2013.01)

(56) References Cited

FOREIGN PATENT DOCUMENTS

| | | |
|---|---|---|
| JP | 2004-286814 | 10/2004 |
| JP | 4120674 | 5/2008 |

* cited by examiner

IMAGE DISPLAY APPARATUS, DRIVING METHOD OF IMAGE DISPLAY APPARATUS, SIGNAL GENERATION APPARATUS, SIGNAL GENERATION PROGRAM, AND SIGNAL GENERATION METHOD

TECHNICAL FIELD

The present disclosure relates to an image display apparatus, a driving method of the image display apparatus, a signal generation apparatus, a signal generation program, and a signal generation method

BACKGROUND ART

In recent years, in order to increase the luminance of an image display apparatus for color display, a technique attracts attention, which has a configuration including not only three sub-pixels, i.e., a red color sub-pixel displaying red color, a green color sub-pixel displaying green color, and a blue color sub-pixel displaying blue color, but also, for example, a white color sub-pixel displaying white color.

For example, Publication of Japanese Patent No. 4120674 (Patent Document 1) describes an image display apparatus including a liquid crystal panel provided with a display pixel including not only a sub-pixel for color display but also a sub-pixel having a transparent or white color area, an illumination apparatus for illuminating the liquid crystal panel, and an display image conversion circuit for determining an image signal corresponding to a sub-pixel on the basis of an input RGB image signal and a control signal for adjusting the luminance of light emitted from the illumination apparatus.

CITATION LIST

Patent Document

Patent Document 1: JP 4120674 B2

SUMMARY OF THE INVENTION

Problems to be Solved by the Invention

In the technique disclosed in Cited Document 1, the luminance of the light emitted from the illumination apparatus is considered to be controllable, and based on the assumption, the image signal corresponding to each sub-pixel is determined on the basis of the input RGB image signal. Therefore, this technique is not suitable for controlling, e.g., a reflection-type image display apparatus for displaying by using reflection of outside light and an image display apparatus having an illumination apparatus having such configuration that the intensity of the output light is fixed.

Therefore, it is a purpose of the present disclosure to provide an image display apparatus, a driving method of an image display apparatus, a signal generation apparatus, a signal generation program, and a signal generation method capable of reliably increasing the luminance even if, e.g., display is performed by reflecting outside light.

Solutions to Problems

An image display apparatus according to the present disclosure for achieving the above purpose includes:

an image display unit in which pixels constituted by a red color sub-pixel, a green color sub-pixel, a blue color sub-pixel, and a white color sub-pixel are arranged in a two-dimensional matrix manner; and a signal generation unit which generates a signal for the red color sub-pixel, a signal for the green color sub-pixel, a signal for the blue color sub-pixel, and a signal for the white color sub-pixel on the basis of an image signal for red color display, an image signal for green color display, and an image signal for blue color display which are provided according to an image to be displayed, wherein the image signal for red color display, the image signal for green color display, and the image signal for blue color display which are linearized and normalized and which correspond to a pixel are denoted as reference symbol $R_{nL}$, reference symbol $G_{nL}$, reference symbol $B_{nL}$, respectively, a minimum value thereof is denoted as $MinRGB_{nL}$, and a threshold defined as a predetermined value is denoted as reference symbol $TH_1$ (however, $0<TH_1<1$), in a case, where $MinRGB_{nL} \leq TH_1$ holds, the signal generation unit generates a signal for each sub-pixel such that:

the value of the signal for the white color sub-pixel is $MinRGB_{nL}/TH_1$, the value of the signal for the red color sub-pixel is $R_{nL}-MinRGB_{nL}$, the value of the signal for the green color sub-pixel is $G_{nL}-MinRGB_{nL}$, and the value of the signal for the blue color sub-pixel is $B_{nL}-MinRGB_{nL}$, and in a case, where $MinRGB_{nL}>TH_1$ holds, the signal generation unit generates a signal for each sub-pixel such that:

the value of the signal for the white color sub-pixel is 1, the value of the signal for the red color sub-pixel is $(R_{nL}-TH_1)/(1-TH_1)$, the value of the signal for the green color sub-pixel is $(G_{nL}-TH_1)/(1-TH_1)$, and the value of the signal for the blue color sub-pixel is $(B_{nL}-TH_1)/(1-TH_1)$.

A driving method of an image display apparatus according to the present disclosure for achieving the above purpose includes an image display unit in which pixels constituted by a red color sub-pixel, a green color sub-pixel, a blue color sub-pixel, and a white color sub-pixel are arranged in a two-dimensional matrix manner, and a signal generation unit which generates a signal for the red color sub-pixel, a signal for the green color sub-pixel, a signal for the blue color sub-pixel, and a signal for the white color sub-pixel on the basis of an image signal for red color display, an image signal for green color display, and an image signal for blue color display which are provided according to an image to be displayed, wherein the image signal for red color display, the image signal for green color display, and the image signal for blue color display which are linearized and normalized and which correspond to a pixel are denoted as reference symbol $R_{nL}$, reference symbol $G_{nL}$, reference symbol $B_{nL}$, respectively, a minimum value thereof is denoted as $MinRGB_{nL}$, and a threshold defined as a predetermined value is denoted as reference symbol $TH_1$ (however, $0<TH_1<1$), in a case, where $MinRGB_{nL} \leq TH_1$ holds, the signal generation unit generates a signal for each sub-pixel such that:

the value of the signal for the white color sub-pixel is $MinRGB_{nL}/TH_1$, the value of the signal for the red color sub-pixel is $R_{nL}-MinRGB_{nL}$, the value of the signal for the green color sub-pixel is $G_{nL}-MinRGB_{nL}$, and the value of the signal for the blue color sub-pixel is $B_{nL}-MinRGB_{nL}$, and in a case, where $MinRGB_{nL}>TH_1$ holds, the signal generation unit generates a signal for each sub-pixel such that:

the value of the signal for the white color sub-pixel is 1, the value of the signal for the red color sub-pixel is $(R_{nL}-TH_1)/(1-TH_1)$, the value of the signal for the green color sub-pixel is $(G_{nL}-TH_1)/(1-TH_1)$, and the value of the signal for the blue color sub-pixel is $(B_{nL}-TH_1)/(1-TH_1)$.

A signal generation program according to the present disclosure for achieving the above purpose is executed by a signal generation apparatus which generates a signal for a red color sub-pixel, a signal for a green color sub-pixel, a signal for a blue color sub-pixel, and a signal for the white color sub-pixel on the basis of an image signal for red color display, an image signal for green color display, and an image signal for blue color display which are provided according to an image to be displayed, wherein the image signal for red color display, the image signal for green color display, and the image signal for blue color display which are linearized and normalized and which correspond to a pixel are denoted as reference symbol $R_{nL}$, reference symbol $G_{nL}$, reference symbol $B_{nL}$, respectively, a minimum value thereof is denoted as $MinRGB_{nL}$, and a threshold defined as a predetermined value is denoted as reference symbol $TH_1$ (however, $0<TH_1<1$), in a case, where $MinRGB_{nL}\leq TH_1$ holds, the signal generation apparatus generates a signal for each sub-pixel such that:

the value of the signal for the white color sub-pixel is $MinRGB_{nL}/TH_1$, the value of the signal for the red color sub-pixel is $R_{nL}-MinRGB_{nL}$, the value of the signal for the green color sub-pixel is $G_{nL}-MinRGB_{nL}$, and the value of the signal for the blue color sub-pixel is $B_{nL}-MinRGB_{nL}$, and in a case, where $MinRGB_{nL}>TH_1$ holds, the signal generation apparatus generates a signal for each sub-pixel such that:

the value of the signal for the white color sub-pixel is 1, the value of the signal for the red color sub-pixel is $(R_{nL}-TH_1)/(1-TH_1)$, the value of the signal for the green color sub-pixel is $(G_{nL}-TH_1)/(1-TH_1)$, and the value of the signal for the blue color sub-pixel is $(B_{nL}-TH_1)/(1-TH_1)$.

A signal generation apparatus according to the present disclosure for achieving the above purpose generates a signal for a red color sub-pixel, a signal for a green color sub-pixel, a signal for a blue color sub-pixel, and a signal for a white color sub-pixel on the basis of an image signal for red color display, an image signal for green color display, and an image signal for blue color display which are provided according to an image to be displayed, wherein the image signal for red color display, the image signal for green color display, and the image signal for blue color display which are linearized and normalized and which correspond to a pixel are denoted as reference symbol $R_{nL}$, reference symbol $G_{nL}$, reference symbol $B_{nL}$, respectively, a minimum value thereof is denoted as $MinRGB_{nL}$, and a threshold defined as a predetermined value is denoted as reference symbol $TH_1$ (however, $0<TH_1<1$), in a case, where $MinRGB_{nL}\leq TH_1$ holds, the signal generation apparatus generates a signal for each sub-pixel such that:

the value of the signal for the white color sub-pixel is $MinRGB_{nL}/TH_1$, the value of the signal for the red color sub-pixel is $R_{nL}-MinRGB_{nL}$, the value of the signal for the green color sub-pixel is $G_{nL}-MinRGB_{nL}$, and the value of the signal for the blue color sub-pixel is $B_{nL}-MinRGB_{nL}$, and in a case, where $MinRGB_{nL}>TH_1$ holds, the signal generation apparatus generates a signal for each sub-pixel such that:

the value of the signal for the white color sub-pixel is 1, the value of the signal for the red color sub-pixel is $(R_{nL}-TH_1)/(1-TH_1)$, the value of the signal for the green color sub-pixel is $(G_{nL}-TH_1)/(1-TH_1)$, and the value of the signal for the blue color sub-pixel is $(B_{nL}-TH_1)/(1-TH_1)$.

A signal generation method according to the present disclosure for achieving the above purpose includes generating a signal for the red color sub-pixel, a signal for the green color sub-pixel, a signal for the blue color sub-pixel, and a signal for the white color sub-pixel on the basis of an image signal for red color display, an image signal for green color display, and an image signal for blue color display which are provided according to an image to be displayed, wherein the image signal for red color display, the image signal for green color display, and the image signal for blue color display which are linearized and normalized and which correspond to a pixel are denoted as reference symbol $R_{nL}$, reference symbol $G_{nL}$, reference symbol $B_{nL}$, respectively, a minimum value thereof is denoted as $MinRGB_{nL}$, and a threshold defined as a predetermined value is denoted as reference symbol $TH_1$ (however, $0<TH_1<1$), in a case, where $MinRGB_{nL}\leq TH_1$ holds, a signal for each sub-pixel is generated such that:

the value of the signal for the white color sub-pixel is $MinRGB_{nL}/TH_1$, the value of the signal for the red color sub-pixel is $R_{nL}-MinRGB_{nL}$, the value of the signal for the green color sub-pixel is $G_{nL}-MinRGB_{nL}$, and the value of the signal for the blue color sub-pixel is $B_{nL}-MinRGB_{nL}$, and in a case, where $MinRGB_{nL}>TH_1$ holds, a signal for each sub-pixel is generated such that:

the value of the signal for the white color sub-pixel is 1, the value of the signal for the red color sub-pixel is $(R_{nL}-TH_1)/(1-TH_1)$, the value of the signal for the green color sub-pixel is $(G_{nL}-TH_1)/(1-TH_1)$, and the value of the signal for the blue color sub-pixel is $(B_{nL}-TH_1)/(1-TH_1)$.

Effects of the Invention

According to image display apparatus and driving method of image display apparatus, and, signal generation apparatus, signal generation program and signal generation method of the present disclosure, an image is displayed by effectively using a white color sub-pixel. Therefore, the luminance of the image displayed can be reliably increased.

MODE FOR CARRYING OUT THE INVENTION

Figure 1:
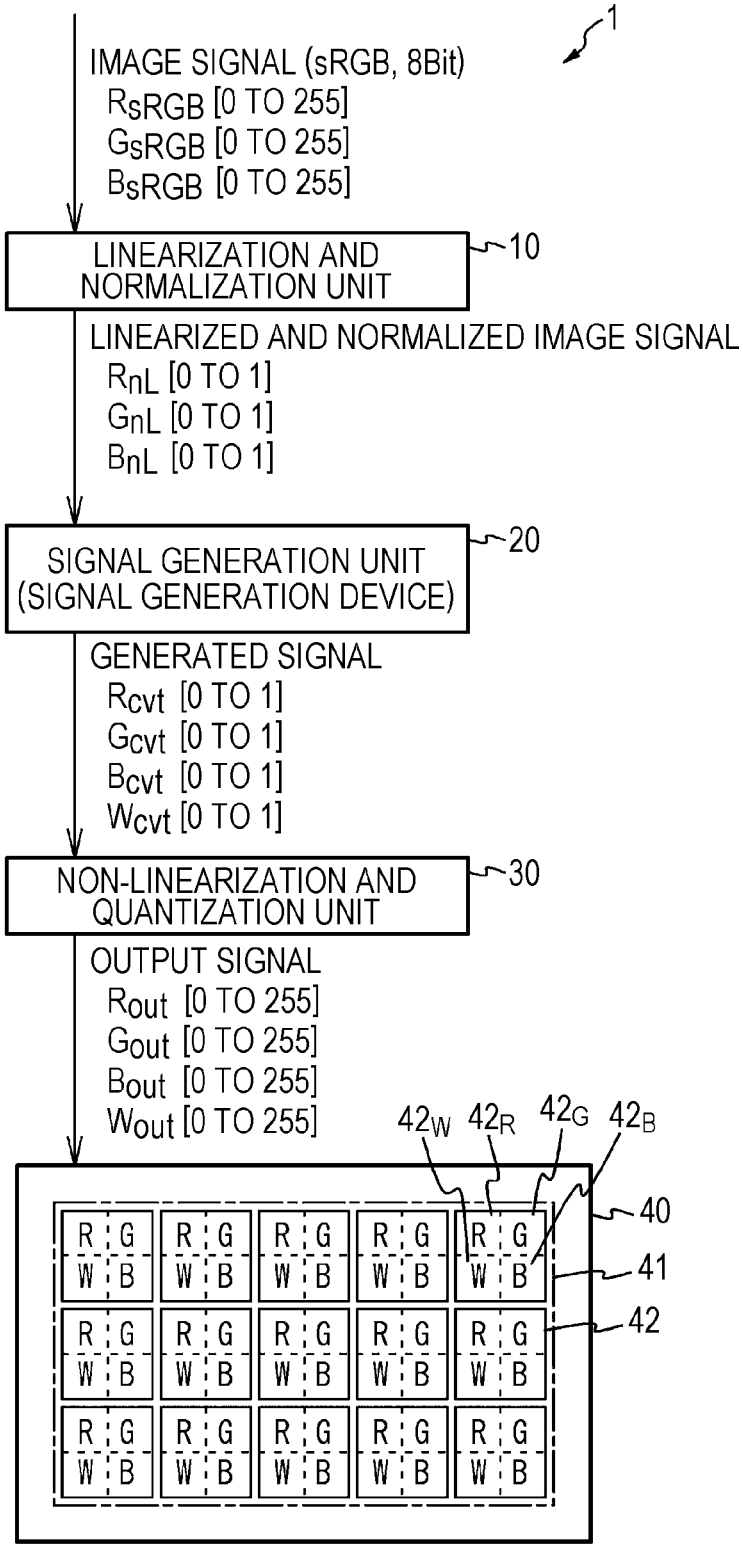
FIG. 1 is a schematic view illustrating an image display apparatus according to a first embodiment.

The present disclosure will be hereinafter explained on the basis of embodiments with reference to drawings, but the present disclosure is not limited to the embodiments, and various numerical values and materials in the embodiments are merely examples. Explanation will be made in the following order. In the explanation below, the same elements or elements having the same function will be denoted with the same reference numeral, and repeated explanation thereabout is omitted. It should be noted that the explanation will be given in the following order.

1. General explanation about an image display apparatus a driving method of the image display apparatus, a signal generation apparatus, a signal generation program, and a signal generation method according to the present disclosure 2. First embodiment and others

[General Explanation about an Image Display Apparatus a Driving Method of the Image Display Apparatus, a Signal Generation Apparatus, a Signal Generation Program, and a Signal Generation Method According to the Present Disclosure]

In the present disclosure, a configuration and a method of an image display unit are not particularly limited. For example, an image display unit may be suitable for display of a motion picture, or may be suitable for display of a still picture, or the image display unit may be reflection-type or a transmission-type. Well-known display unit materials such as a reflection-type liquid crystal display panel and an electronic paper can be used as a reflection-type image display unit. Well-known display unit materials such as a transmission-type liquid crystal display panel can be used as a transmission-type image display unit. It should be noted that the transmission-type image display unit includes a semi-transmission-type image display unit which has the features of both of the transmission-type and the reflection-type.

Examples of pixel values include several image display resolutions such as not only VGA (640, 480), S-VGA (800, 600), XGA (1024, 768), APRC (1152, 900), S-XGA (1280, 1024), U-XGA (1600, 1200), HD-TV (1920, 1080), and Q-XGA (2048, 1536), but also (1920, 1035), (720, 480), and (1280, 960), but the values are not limited thereto.

In the present disclosure, a predetermined threshold $TH_1$ may be set appropriately in accordance with a configuration such as an image display unit. In this case, where the maximum luminance of white color display in design that can be displayed by a red color sub-pixel, a green color sub-pixel, and a blue color sub-pixel in a single pixel is denoted as $W_{R+G+B_max}$, and the maximum brightness of white color display in design that can be displayed by a white color sub-pixel in a single pixel is denoted as $W_{W_max}$, the value of the threshold $TH_1$ is configured to be set to a value given by $W_{W_max}/(W_{R+G+B_max}+W_{W_max})$, so that the increase of the brightness of the image due to the white color sub-pixel can be best achieved. The values of the brightness $W_{R+G+B_max}$, $W_{W_max}$ explained above can be obtained on the basis of the structure of the image display unit, or can be measured by operating the image display unit.

A signal generation unit and a signal generation apparatus used in the present disclosure can be constituted from, for example, a calculation circuit and a storage apparatus. They can be constituted by using well-known circuit elements and the like. This is also applicable to a linearization and normalization unit and a non-linearization and quantization unit as shown in FIG. 1 explained later.

For example, the signal generation unit and the signal generation apparatus may be configured to operate on the basis of physical wiring made by hardware, or may be configured to operate on the basis of a program.

Various conditions shown in this specification are satisfied not only when they strictly hold but also when they substantially hold. For example, it is sufficient that "red color" be recognized as substantially red color, and it is sufficient that "green color" be recognized as substantially green color. This is also applicable to the "blue color" and the "white color". It is tolerated to have various kinds of variations that occur in design and in production.

First Embodiment

The first embodiment relates to an image display apparatus a driving method of the image display apparatus, a signal generation apparatus, a signal generation program, and a signal generation method according to the present disclosure.

For the sake of convenience of explanation, an externally input image signal is, for example, a signal of 8-bit sRGB method ($\gamma$=2.4), and the image display unit displays an image on the basis of a signal according to an sRGB method. Among the externally input image signals, the image signal for red color display is denoted as reference symbol $R_{sRGB}$, the image signal for green color display is denoted as reference symbol $G_{sRGB}$, and the image signal for blue color display is denoted as reference symbol $B_{sRGB}$. The image signals $R_{sRGB}$, $G_{sRGB}$, $B_{sRGB}$ have values between 0 to 255 in accordance with the luminance of the image to be displayed. In the explanation about this case, a value of [0] indicates the minimum luminance, and a value of [255] indicates the maximum luminance.

FIG. 1 is a schematic view illustrating an image display apparatus according to the first embodiment.

The image display apparatus 1 according to the first embodiment includes an image display unit 40 in which pixels 42 constituted by the red color sub-pixel $\mathbf{42}_R$, the green color sub-pixel $\mathbf{42}_G$, the blue color sub-pixel $\mathbf{42}_B$ the and white color sub-pixel $\mathbf{42}_W$ are arranged in a two-dimensional matrix manner, and a signal generation unit (signal generation apparatus) 20 for generating the signal for the red color sub-pixel, the signal for the green color sub-pixel, the signal for the blue color sub-pixel, and the signal for the white color sub-pixel on the basis of an image signal for red color display, an image signal for green color display, and an image signal for blue color display provided according to the image to be displayed. In the image display unit 40, a display area having pixels 42 arranged in a two-dimensional matrix manner is denoted by reference symbol 41.

The image display apparatus 1 further includes a linearization and normalization unit 10 for making the externally input image signal $R_{sRGB}$, $G_{sRGB}$, $B_{sRGB}$ into linearized and normalized image signal, and a non-linearization and quantization unit 30 for making generated signals $R_{cvt}$, $G_{cvt}$, $B_{cvt}$, $W_{cvt}$ into output signals of 8-bit sRGB method.

The image display unit 40 is constituted by, for example, electronic paper or a reflection-type liquid crystal display panel. More specifically, the image display unit 40 is the reflection-type, and displays an image by changing the reflectance of outside light incident upon the image display unit 40. It should be noted that the image display unit 40 may be configured to be a transmission-type (for example, a combination of a transmission-type liquid crystal display panel and a backlight configured to have fixed strength of output light).

The red color sub-pixel $\mathbf{42}_R$ has such a structure made by laminating, for example, a color filter transmitting red color and a reflection area where the degree of reflection of light can be controlled. Red color is displayed by controlling the reflectance of the incident outside light. Likewise, the green color sub-pixel $\mathbf{42}_G$ has such structure made by laminating, for example, a color filter transmitting green color and a reflection area. The blue color sub-pixel $\mathbf{42}_B$ has such structure made by laminating, for example, a color filter transmitting blue color and a reflection area.

In this case, in order to help understanding, the improvement of the luminance of an image by adding the white color sub-pixel $\mathbf{42}_W$ will be explained. First, a case, where the white color sub-pixel $\mathbf{42}_W$ is not provided will be explained.

Figure 2:
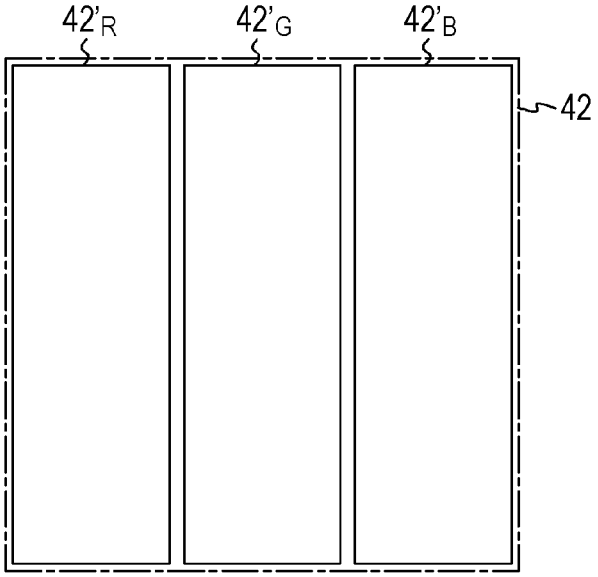
FIG. 2 is a schematic top view for explaining brightness in a case, where white color is displayed with the maximum luminance in design when assuming a pixel is constituted by three sub-pixels including a red color sub-pixel, a green color sub-pixel, and a blue color sub-pixel.

FIG. 2 is a schematic top view for explaining brightness in a case, where white color is displayed with the maximum luminance in design when assuming a pixel is constituted by three sub-pixels including a red color sub-pixel, a green color sub-pixel, and a blue color sub-pixel.

For the sake of explanation, the size of area occupied by a single pixel 42 is denoted as reference symbol $S_{PX}$, and the red color sub-pixel, the green color sub-pixel, and the blue color sub-pixel are denoted as reference symbols $\mathbf{42}_R'$, $\mathbf{42}_G'$ and $\mathbf{42}_B'$, respectively. The size of area occupied by each sub-pixel is considered to be approximately $S_{PX}/3$.

The red color sub-pixel $\mathbf{42}_R'$, green color sub-pixel $\mathbf{42}_G'$, blue color sub-pixel $\mathbf{42}_B'$ displays white color by using additive color mixture (more specifically, juxtaposition additive color mixture).

For the sake of explanation, in this case, the outside light of white color having a certain strength is incident upon the pixel 42, and when the red color sub-pixel $\mathbf{42}_R'$ attains the maximum luminance in design, approximately half of the red color component of the outside light is reflected, and when the green color sub-pixel $\mathbf{42}_G'$ attains the maximum luminance in design, approximately half of the green color component of the outside light is reflected, and when the blue color sub-pixel $\mathbf{42}_B'$ attains the maximum luminance in design, approximately half of the green color component of the outside light is reflected. This is also applicable the explanation with reference to FIG. 3 described later.

In this case, where the brightness of the outside light incident upon the pixel 42 is denoted as "1", the maximum luminance in design produced by the white color display made through additive color mixture for adding the red color sub-pixel $\mathbf{42}_R'$, the green color sub-pixel $\mathbf{42}_G'$, and the blue color sub-pixel $\mathbf{42}_B'$ is approximately "½". More specifically, the brightness of the output light is approximately "½".

Subsequently, a case, where the white color sub-pixel $\mathbf{42}_W$ is provided will be explained.

Figure 3:
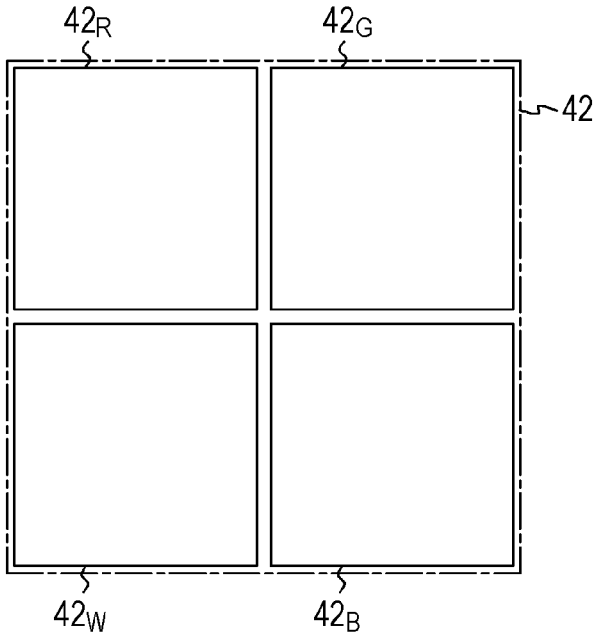
FIG. 3 is a schematic top view for explaining brightness in a case, where white color is displayed with the maximum luminance in design when a pixel is constituted by four sub-pixels including a red color sub-pixel, a green color sub-pixel, a blue color sub-pixel, and a white color sub-pixel in an image display unit.

FIG. 3 is a schematic top view for explaining brightness in a case, where white color is displayed with the maximum luminance in design when a pixel is constituted by four sub-pixels including a red color sub-pixel, a green color sub-pixel, a blue color sub-pixel, and a white color sub-pixel in an image display unit.

For the sake of explanation, the size of area occupied by the red color sub-pixel $\mathbf{42}_R$, the green color sub-pixel $\mathbf{42}_G$, the blue color sub-pixel $\mathbf{42}_B$ and the white color sub-pixel $\mathbf{42}_W$ is approximately $S_{PX}/4$.

In FIG. 3, the size of area occupied by the red color sub-pixel $\mathbf{42}_R$, the green color sub-pixel $\mathbf{42}_G$, and the blue color sub-pixel $\mathbf{42}_B$ is ¾ of the size of area occupied by the red color sub-pixel $\mathbf{42}_R'$, the green color sub-pixel $\mathbf{42}_G'$, and the blue color sub-pixel $\mathbf{42}_B'$ in FIG. 2. Therefore, the brightness of the white color in the additive color mixture of the red color sub-pixel $\mathbf{42}_R$, the green color sub-pixel $\mathbf{42}_G$, and the blue color sub-pixel $\mathbf{42}_B$ (the brightness of the output light) is "½"×"¾", which is "⅜".

When all the outside light of white color is reflected when the white color sub-pixel $\mathbf{42}_W$ attains the maximum luminance, the brightness of the white color of the white color sub-pixel $\mathbf{42}_W$ (the brightness of the output light) is "¼" because of the size of area occupied by the white color sub-pixel, where the brightness of the outside light incident upon the pixel 42 is "1".

Therefore, the brightness of the pixel in FIG. 3 is "⅜"+"¼", which is approximately "⅝".

As described above, when the white color is displayed with the maximum luminance in design, the configuration of FIG. 3 can enhance the luminance of the image more greatly than the configuration of FIG. 2.

The improvement of the luminance of the image obtained by adding the white color sub-pixel $\mathbf{42}_W$ has been hereinabove explained. Subsequently, operation according to the first embodiment will be explained in a more specific manner. It should be noted that operation explained below is performed for each signal corresponding to a single pixel.

In the first embodiment, the signal generation unit (signal generation apparatus) 20 constituting the image display apparatus 1 operates on the basis of a signal generation program stored in storage means, not shown. The image signal for red color display, the image signal for green color display, and the image signal for blue color display which are linearized and normalized and correspond to a pixel are denoted as reference symbol $R_{nL}$, reference symbol $G_{nL}$, and reference symbol $B_{nL}$, and where the minimum value thereof is denoted as $MinRGB_{nL}$, and a threshold defined as a predetermined value is denoted as reference symbol $TH_1$ (however, $0<TH_1<1$), the signal generation unit (signal generation apparatus) generates a signal for each sub-pixel such that, where $MinRGB_{nL} \leq TH_1$ holds, the value of the signal for the white color sub-pixel is $MinRGB_{nL}/TH_1$, the value of the signal for the red color sub-pixel is $R_{nL}-MinRGB_{nL}$, the value of the signal for the green color sub-pixel is $G_{nL}-MinRGB_{nL}$, and the value of the signal for the blue color sub-pixel is $B_{nL}-MinRGB_{nL}$, and the signal generation unit (signal generation apparatus) 20 generates a signal for each sub-pixel such that, where $MinRGB_{nL}>TH_1$ holds, the value of the signal for the white color sub-pixel is 1, the value of the signal for the red color sub-pixel is $(R_{nL}-TH_1)/(1-TH_1)$, the value of the signal for the green color sub-pixel is $(G_{nL}-TH_1)/(1-TH_1)$, and the value of the signal for the blue color sub-pixel is $(B_{nL}-TH_1)/(1-TH_1)$.

In the first embodiment, where the maximum brightness of the white color display in design that can be displayed by the red color sub-pixel $\mathbf{42}_R$, the green color sub-pixel $\mathbf{42}_G$, and the blue color sub-pixel $\mathbf{42}_B$ in a single pixel 42 is denoted as $W_{R+G+B_max}$, and the maximum brightness of the white color display in design that can be displayed by the white color sub-pixel $\mathbf{42}_W$ in a single pixel 42 is denoted as $W_{W_max}$, the threshold $TH_1$ explained above is set to a value given by $W_{W_max}/(W_{R+G+B_max}+W_{W_max})$.

In the example as shown in FIG. 3, the value given by $W_{W_max}/(W_{R+G+B_max}+W_{W_max})$ is [0.4].

The linearization and normalization unit 10 generates a linearized and normalized signal on the basis of the input image signals $R_{sRGB}$, $G_{sRGB}$, $B_{sRGB}$.

For the sake of explanation, first, generation of a signal $R_{nL}$ for red color display will be explained. By using the following expressions (1) to (3), the signal $R_{nL}$ can be generated. It should be noted that reference symbol $R_{temp1}$ in the expressions (1) to (3) is a temporary variable used for the sake of explanation.

$$R_{temp1}=R_{sRGB}/255 \tag{1}$$

Where $R_{temp1}\leq 0.04045$ holds, the following expression is calculated.

$$R_{nL}=R_{temp1}/12.92 \tag{2}$$

Where $R_{temp1}>0.04045$ holds, the following expression is calculated.

$$R_{nL}=((R_{temp1}+0.055)/1.055^{2.4} \tag{3}$$

The signal $G_{nL}$ for green color display and the signal $B_{nL}$ for blue color display which are linearized and normalized can be generated on the basis of the similar expression. For example, when the signal $G_{nL}$ is generated, reference symbol $R_{temp1}$ may be deemed to be replaced with reference symbol $G_{temp1}$, reference symbol $R_{nL}$ may be deemed to be replaced with reference symbol $G_{nL}$ in the expressions (1) to (3), and the signal $B_{nL}$ may also be generated by appropriately replacing the variables.

Subsequently, operation of the signal generation unit 20 as shown in FIG. 1 will be explained. The signal generation unit 20 generates a signal for each sub-pixel on the basis of linearized and normalized signals $R_{nL}$, $G_{nL}$, $B_{nL}$ and the threshold $TH_1$ defined as a predetermined value. The signal for the red color sub-pixel is denoted as reference symbol $R_{cvt}$, the signal for the green color sub-pixel is denoted as reference symbol $G_{cvt}$, the signal for the blue color sub-pixel is denoted as reference symbol $B_{cvt}$, and the signal for the white color sub-pixel is denoted as reference symbol $W_{cvt}$.

Operation for generating the signals $R_{cvt}$, $G_{cvt}$, $B_{cvt}$, $W_{cvt}$ on the basis of the signal $R_{nL}$, $G_{nL}$, $B_{nL}$ and the threshold $TH_1$ will be explained.

The minimum value of the signals $R_{nL}$, $G_{nL}$, $B_{nL}$ is denoted as reference symbol $MinRGB_{nL}$. The minimum value $MinRGB_{nL}$ can be expressed as in the following expression (4) using a function min that outputs the minimum value of the argument.

$$MinRGB_{nL}=\min(R_{nL},G_{nL},B_{nL}) \tag{4}$$

Then, where $MinRGB_{nL}\leq TH_1$ holds, the signal is generated on the basis of the following expressions (5), (6), (7), (8).

$$W_{cvt}=MinRGB_{nL}/TH_1 \tag{5}$$

$$\begin{aligned} R_{cvt} &= R_{nL}-W_{cvt}\times TH_1 \\ &= R_{nL}-W_{cvt} \end{aligned} \tag{6}$$

$$\begin{aligned} G_{cvt} &= G_{nL}-W_{cvt}\times TH_1 \\ &= G_{nL}-W_{cvt} \end{aligned} \tag{7}$$

$$\begin{aligned} B_{cvt} &= B_{nL}-W_{cvt}\times TH_1 \\ &= B_{nL}-W_{cvt} \end{aligned} \tag{8}$$

Where $MinRGB_{nL}>TH_1$ holds, the signal is generated on the basis of the following expressions (9), (10), (11), (12).

$$W_{cvt}=1 \tag{9}$$

$$\begin{aligned} R_{cvt} &= (R_{nL}-W_{cvt}\times TH_1)/(1-TH_1) \\ &= (R_{nL}-TH_1)/(1-TH_1) \end{aligned} \tag{10}$$

$$\begin{aligned} G_{cvt} &= (G_{nL}-W_{cvt}\times TH_1)/(1-TH_1) \\ &= (G_{nL}-TH_1)/(1-TH_1) \end{aligned} \tag{11}$$

$$\begin{aligned} B_{cvt} &= (B_{nL}-W_{cvt}\times TH_1)/(1-TH_1) \\ &= (B_{nL}-TH_1)/(1-TH_1) \end{aligned} \tag{12}$$

Operation of the signal generation unit 20 has been hereinabove explained.

The generated signals $W_{cvt}$, $R_{cvt}$, $G_{cvt}$, $B_{cvt}$ are input into the non-linearization and quantization unit 30, which outputs them as digital signals of the sRGB method. Among the digitalized signals, the signal for the red color sub-pixel is denoted as reference symbol $R_{out}$, the signal for the green color sub-pixel is denoted as reference symbol $G_{out}$, the signal for the blue color sub-pixel is denoted as reference symbol $B_{out}$, and the signal for the white color sub-pixel is denoted as reference symbol $W_{out}$.

For the sake of explanation, first, the signal for the red color sub-pixel $R_{out}$ will be explained. The signal $R_{out}$ can be generated on the basis of the following expressions (13) to (15). It should be noted that reference symbol $R_{temp2}$ in the expressions (13) to (15) is a temporary variable for the sake of calculation. The function round in the expression (15) is a function for rounding off a numerical value to an integer.

Where $R_{cvt}\leq 0.0031308$ holds, the following expression is calculated.

$$R_{temp2}=12.02\times R_{cvt} \tag{13}$$

Where $R_{cvt}>0.0031308$ holds, the following expression is calculated.

$$R_{temp2}=1.055\times R_{cvt}^{1/2.4}-0.055 \tag{14}$$

$$R_{out}=\mathrm{round}(255\times R_{temp2}) \tag{15}$$

The signal for the green color sub-pixel $G_{out}$, the signal for the blue color sub-pixel $B_{out}$, and the signal for the white color sub-pixel $W_{out}$ can also be generated on the basis of the similar expression. For example, in order to generate the signal $G_{out}$, reference symbol $R_{temp2}$ may be deemed to be replaced with reference symbol $G_{temp1}$, reference symbol $R_{cvt}$ may be deemed to be replaced with reference symbol $G_{cvt}$, and reference symbol $R_{out}$ may be deemed to be replaced with reference symbol $G_{out}$ in the expressions (13) to (15). The signals $B_{out}$, $W_{out}$ may also be generated by appropriately replacing the variables.

The image display unit 40 operates on the basis of the signal for the red color sub-pixel $R_{out}$, the signal for the green color sub-pixel $G_{out}$, the signal for the blue color sub-pixel $B_{out}$, and the signal for the white color sub-pixel $W_{out}$, and displays an image.

Subsequently, an example of data generated will be explained with reference to FIGS. 4, 5, and 6.

Figure 4:
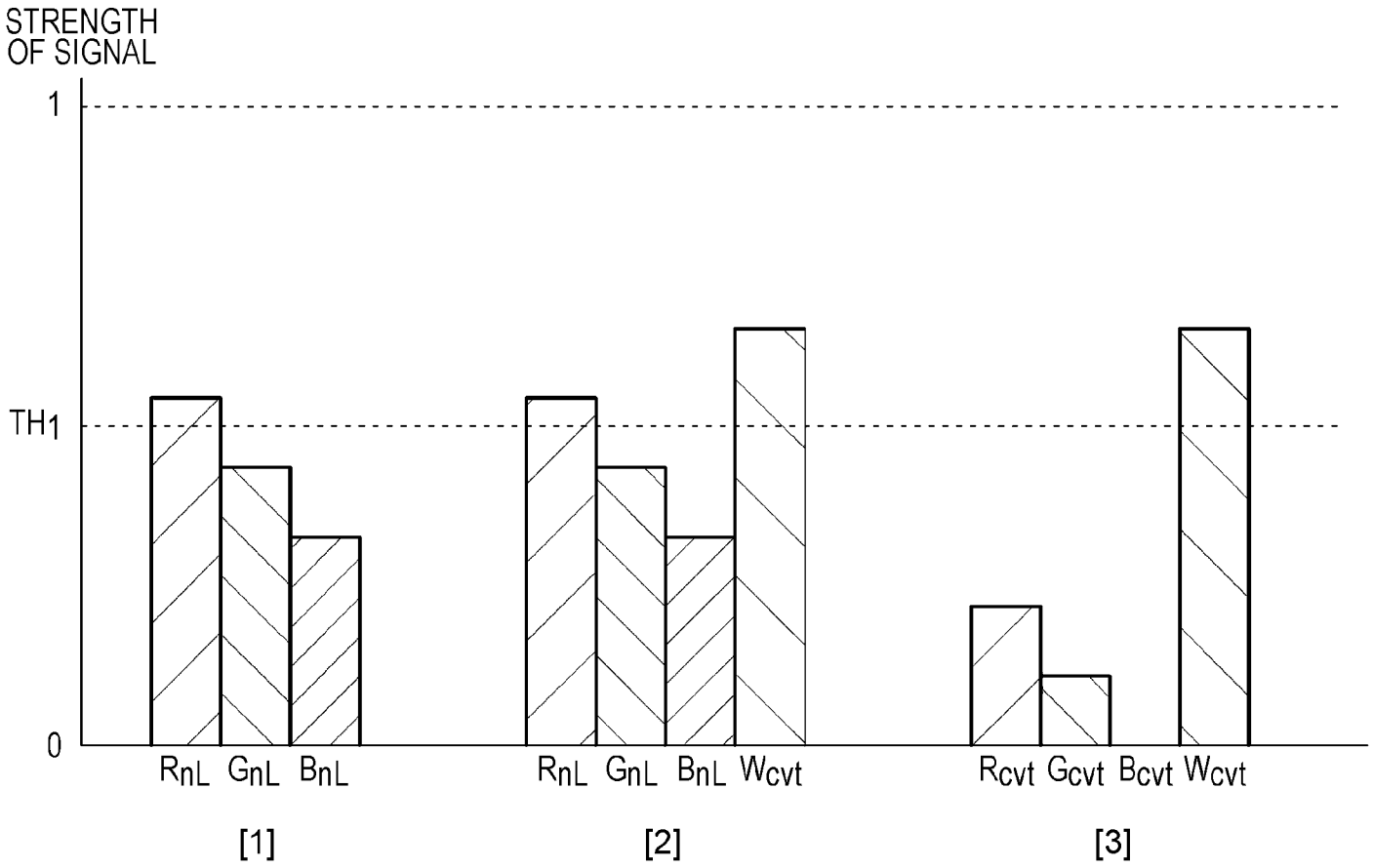
FIG. 4 is a schematic graph for explaining processing in a case, where $MinRGB_{nL} \leq TH_1$ holds.

FIG. 4 is a schematic graph for explaining processing in a case, where $MinRGB_{nL} \leq TH_1$ holds.

In the example of FIG. 4, the smallest of the signals $R_{nL}$, $G_{nL}$, $B_{nL}$ is the signal $B_{nL}$ ([1] in the drawing). The signal $W_{cvt}$ attains $W_{cvt}=B_{nL}/TH_1=2\times B_{nL}$ ([2] in the drawing) on the basis of the processing explained above. Then, the following expressions are satisfied: $R_{cvt}=R_{nL}-B_{nL}$, $G_{cvt}=G_{nL}-B_{nL}$, and $B_{cvt}=B_{nL}-B_{nL}$ ([3] in the drawing).

Figure 5:
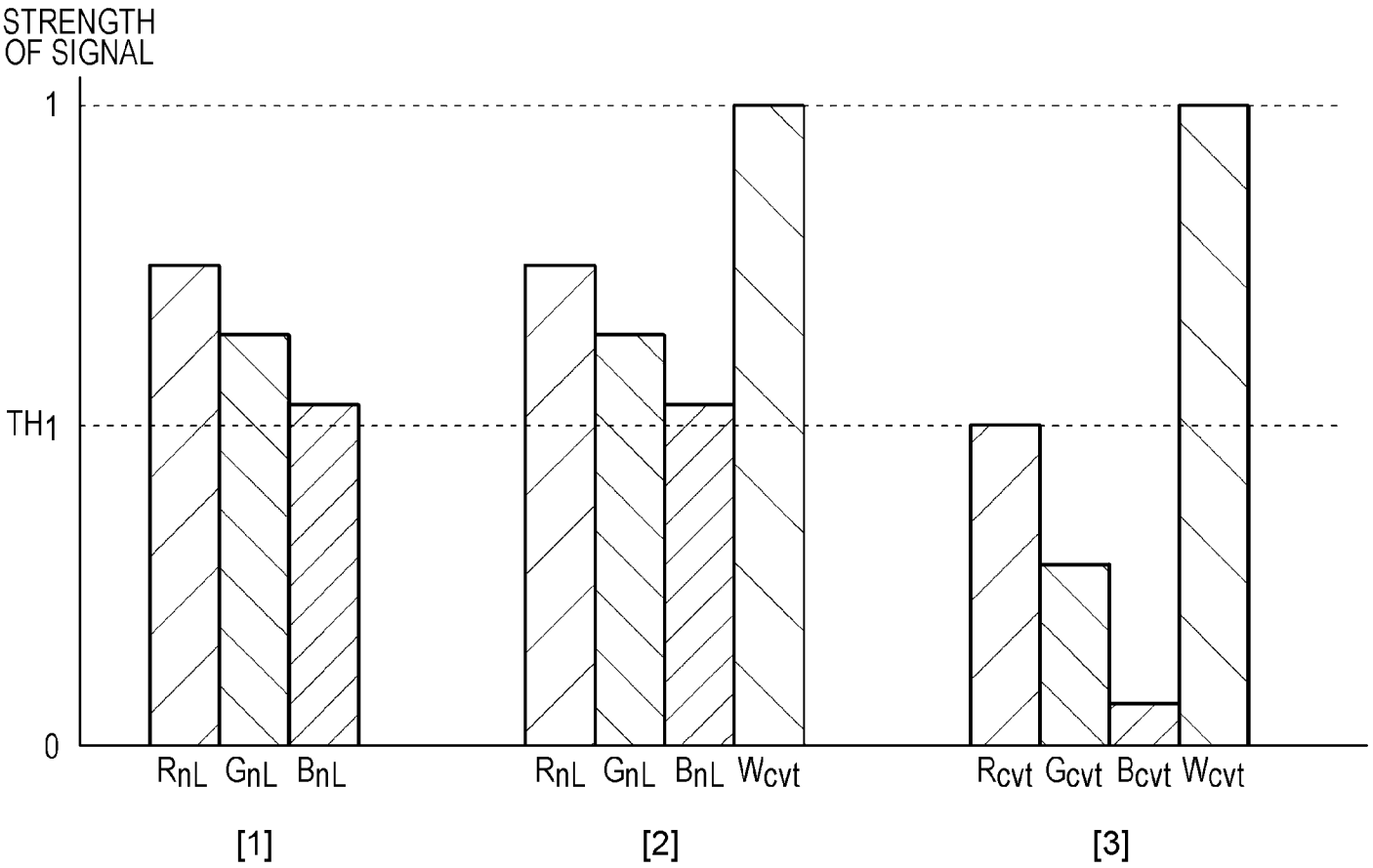
FIG. 5 is a schematic graph for explaining processing in a case, where $MinRGB_{nL} > TH_1$ holds.

FIG. 5 is a schematic graph for explaining processing in a case, where $MinRGB_{nL} > TH_1$ holds.

In the example of FIG. 5, the smallest of the signals $R_{nL}$, $G_{nL}$, $B_{nL}$ is the signal $B_{nL}$ ([1] in the drawing). The signal $W_{cvt}$ attains $W_{cvt}=1$ ([2] in the drawing) on the basis of the processing explained above. Then, the following expressions are satisfied: $R_{cvt}=(R_{nL}-TH_1)/(1-TH_1)=(R_{nL}-0.5)\times 2$, $G_{cvt}=(G_{nL}-TH_1)/(1-TH_1)=(G_{nL}-0.5)\times 2$, and $B_{cvt}=(B_{nL}-TH_1)/(1-TH_1)=(B_{nL}-0.5)\times 2$ ([3] in the drawing).

Figure 6:
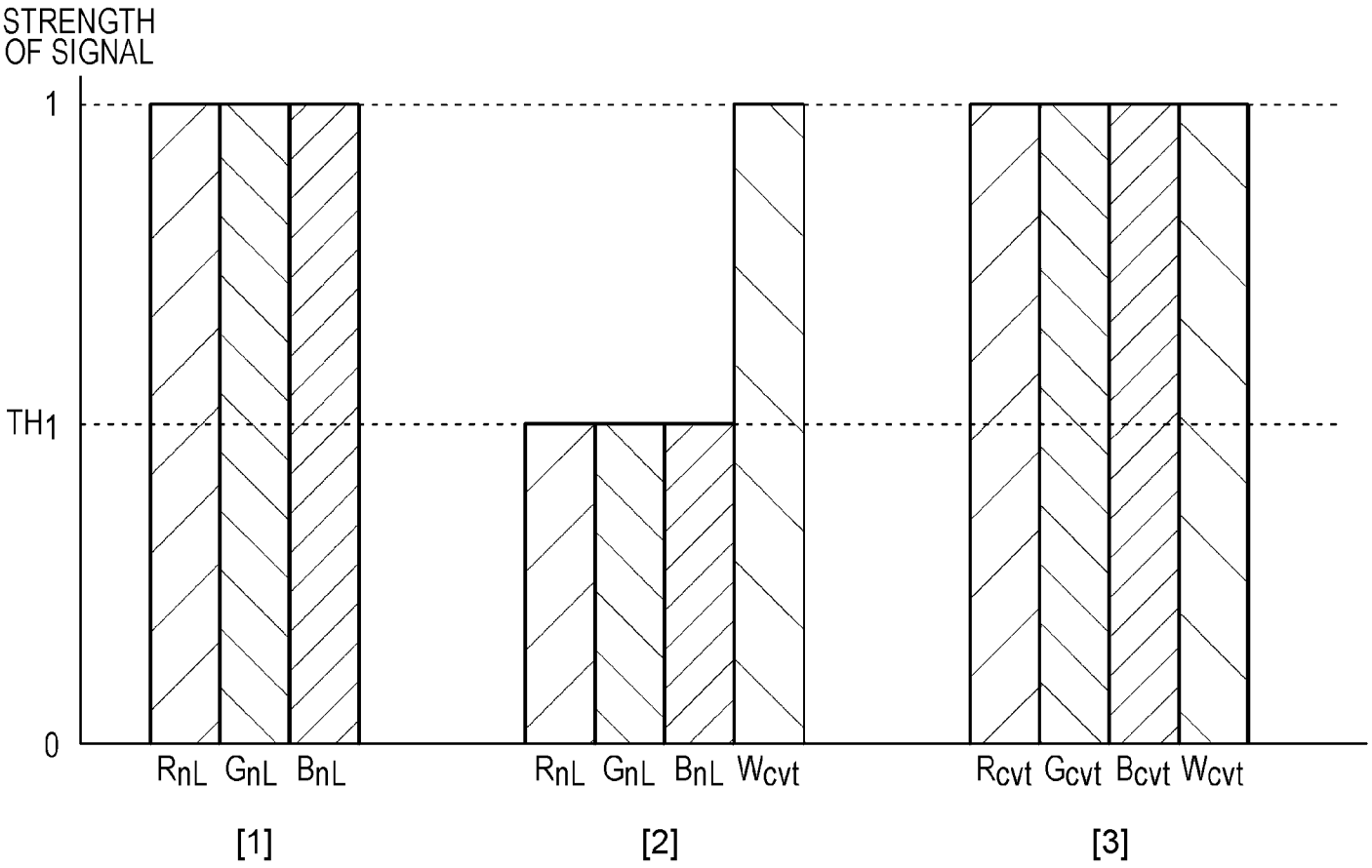
FIG. 6 is a schematic graph for explaining processing in a case, where a video signal displaying white color with the maximum luminance is input.

FIG. 6 is a schematic graph for explaining processing in a case, where a video signal displaying white color with the maximum luminance is input.

In this case, the signals $R_{nL}$, $G_{nL}$, $B_{nL}$ are 1 ([1] in the drawing). The signal $W_{cvt}$ attains $W_{cvt}=1$ ([2] in the drawing) on the basis of the processing explained above. Then, the following expressions are satisfied: $R_{cvt}=(R_{nL}-TH_1)/(1-TH_1)=(1-0.5)\times 2=1$, $G_{cvt}=(G_{nL}-TH_1)/(1-TH_1)=(1-0.5)\times 2=1$, and $B_{cvt}=(B_{nL}-TH_1)/(1-TH_1)=(1-0.5)\times 2=1$ ([3] in the drawing).

As described above, where a video signal displaying white color with the maximum luminance is input, the signals are generated so that the signal for the red color sub-pixel $R_{cvt}$, the signal for the green color sub-pixel $G_{cvt}$, the signal for the blue color sub-pixel $B_{cvt}$ and the signal for the white color sub-pixel $W_{cvt}$ become [1]. Therefore, the white color can be displayed with the maximum luminance of the image display unit 40 in design.

The operation of the first embodiment has been hereinabove explained. Subsequently, the effects of the first embodiment will be explained with comparison with operation of a reference example in order to help understanding.

For example, a reference example may be considered in which the minimum value of the signals $R_{nL}$, $G_{nL}$, $B_{nL}$ is adopted as the value of the signal $W_{cvt}$, and the signals $R_{cvt}$, $G_{cvt}$, $B_{cvt}$ are obtained by subtracting the signal $W_{cvt}$ from the signals $R_{nL}$, $G_{nL}$, $B_{nL}$, respectively. More specifically, the processing as shown in the following expressions (15) to (18) will be performed.

$$W_{cvt}=\mathrm{Min}RGB_{nL} \tag{15}$$

$$R_{cvt}=R_{nL}-W_{cvt} \tag{16}$$

$$G_{cvt}=G_{nL}-W_{cvt} \tag{17}$$

$$B_{cvt}=B_{nL}-W_{cvt} \tag{18}$$

However, in this method, when all of the signals $R_{nL}$, $G_{nL}$, $B_{nL}$ are [1], $W_{cvt}$ is 1, $R_{cvt}$, $G_{cvt}$, $B_{cvt}$ are 0. Therefore, unlike the first embodiment, the luminance of the image cannot be improved by adding a white color sub-pixel.

For example, a reference example may be considered, in which the minimum value of the signals $R_{nL}$, $G_{nL}$, $B_{nL}$ is adopted as the value of the signal $W_{cvt}$, and the signals $R_{nL}$, $G_{nL}$, $B_{nL}$ are adopted as the signals $R_{cvt}$, $G_{cvt}$, $B_{cvt}$, respectively, as they are. More specifically, the processing as shown in the following expressions (19) to (22) is performed.

$$W_{cvt}=\mathrm{Min}RGB_{nL} \tag{19}$$

$$R_{cvt}=R_{nL} \tag{20}$$

$$G_{cvt}=G_{nL} \tag{21}$$

$$B_{cvt}=B_{nL} \tag{22}$$

However, according to this method, when the signal is changed so that the minimum value or the maximum value of the signals $R_{nL}$, $G_{nL}$, $B_{nL}$ becomes constant, the difference between the chromaticity calculated from the signals $R_{nL}$, $G_{nL}$, $B_{nL}$ and the chromaticity calculated from the signals $R_{cvt}$, $G_{cvt}$, $B_{cvt}$, $W_{cvt}$ is larger than that of the first embodiment.

For example, a reference example may be considered, in which the average value of the signals $R_{nL}$, $G_{nL}$, $B_{nL}$ is adopted as the value of the signal $W_{cvt}$, and the signals $R_{nL}$, $G_{nL}$, $B_{nL}$ are adopted as the signals $R_{cvt}$, $G_{cvt}$, $B_{cvt}$, respectively, as they are. More specifically, the processing as shown in the following expressions (23) to (26) is performed. It should be noted that $AveRGB_{nL}$ as shown in the expression (23) denotes the average value of the signals $R_{nL}$, $G_{nL}$, $B_{nL}$.

$$W_{cvt}=\mathrm{Ave}RGB_{nL} \tag{23}$$

$$R_{cvt}=R_{nL} \tag{24}$$

$$G_{cvt}=G_{nL} \tag{25}$$

$$B_{cvt}=B_{nL} \tag{26}$$

However, according to this method, when the difference between the maximum value and the minimum value of the signals $R_{nL}$, $G_{nL}$, $B_{nL}$ is larger, the difference between the chromaticity calculated from the signals $R_{nL}$, $G_{nL}$, $B_{nL}$ and the chromaticity calculated from the signals $R_{cvt}$, $G_{cvt}$, $B_{cvt}$, $W_{cvt}$ becomes larger than that of the first embodiment.

The embodiment according to this invention has been hereinabove explained in a specific manner, but this invention is not limited to the above embodiment, and various modifications can be made on the basis of the technical concepts of this invention.

For example, not only the threshold $TH_1$ but also another threshold may be set, and the signal processing may be configured to be switched in accordance with the relationship in the magnitude with $MinRGB_{nL}$.

It should be noted that the technique of the present disclosure may be also be configured as follows.

[1]

An image display apparatus including:

an image display unit in which pixels constituted by a red color sub-pixel, a green color sub-pixel, a blue color sub-pixel, and a white color sub-pixel are arranged in a two-dimensional matrix manner; and a signal generation unit which generates a signal for the red color sub-pixel, a signal for the green color sub-pixel, a signal for the blue color sub-pixel, and a signal for the white color sub-pixel on the basis of an image signal for red color display, an image signal for green color display, and an image signal for blue color display which are provided according to an image to be displayed, wherein the image signal for red color display, the image signal for green color display, and the image signal for blue color display which are linearized and normalized and which correspond to a pixel are denoted as reference symbol $R_{nL}$, reference symbol $G_{nL}$, reference symbol $B_{nL}$, respectively, a minimum value thereof is denoted as $MinRGB_{nL}$, and a threshold defined as a predetermined value is denoted as reference symbol $TH_1$ (however, $0<TH_1<1$), in a case, where $MinRGB_{nL} \leq TH_1$ holds, the signal generation unit generates a signal for each sub-pixel such that:

the value of the signal for the white color sub-pixel is $MinRGB_{nL}/TH_1$, the value of the signal for the red color sub-pixel is $R_{nL}-MinRGB_{nL}$, the value of the signal for the green color sub-pixel is $G_{nL}-MinRGB_{nL}$, and the value of the signal for the blue color sub-pixel is $B_{nL}-MinRGB_{nL}$, and in a case, where $MinRGB_{nL}>TH_1$ holds, the signal generation unit generates a signal for each sub-pixel such that:

the value of the signal for the white color sub-pixel is 1, the value of the signal for the red color sub-pixel is $(R_{nL}-TH_1)/(1-TH_1)$, the value of the signal for the green color sub-pixel is $(G_{nL}-TH_1)/(1-TH_1)$, and the value of the signal for the blue color sub-pixel is $(B_{nL}-TH_1)/(1-TH_1)$.

[2]

The image display apparatus according to the above [1], wherein a maximum brightness of white color display in design that can be displayed by the red color sub-pixel, the green color sub-pixel, and the blue color sub-pixel in a single pixel is denoted as $W_{R+G+B_max}$, and a maximum brightness of white color display in design that can be displayed by the white color sub-pixel in a single pixel is denoted as $W_{W_max}$, and in this case the value of the threshold $TH_1$ is set to a value given by $W_{W_max}/(W_{R+G+B_max}+W_{W_max})$.

[3]

The image display apparatus according to the above [1] or [2], wherein the image display unit is a reflection-type.

[4]

The image display apparatus according to the above [1] or [2], wherein the image display unit is a transmission-type.

[5]

A driving method of an image display apparatus including an image display unit in which pixels constituted by a red color sub-pixel, a green color sub-pixel, a blue color sub-pixel, and a white color sub-pixel are arranged in a two-dimensional matrix manner, and a signal generation unit which generates a signal for the red color sub-pixel, a signal for the green color sub-pixel, a signal for the blue color sub-pixel, and a signal for the white color sub-pixel on the basis of an image signal for red color display, an image signal for green color display, and an image signal for blue color display which are provided according to an image to be displayed, wherein the image signal for red color display, the image signal for green color display, and the image signal for blue color display which are linearized and normalized and which correspond to a pixel are denoted as reference symbol $R_{nL}$, reference symbol $G_{nL}$, reference symbol $B_{nL}$, respectively, a minimum value thereof is denoted as $MinRGB_{nL}$, and a threshold defined as a predetermined value is denoted as reference symbol $TH_1$ (however, $0<TH_1<1$), in a case, where $MinRGB_{nL} \leq TH_1$ holds, the signal generation unit generates a signal for each sub-pixel such that:

the value of the signal for the white color sub-pixel is $MinRGB_{nL}/TH_1$, the value of the signal for the red color sub-pixel is $R_{nL}-MinRGB_{nL}$, the value of the signal for the green color sub-pixel is $G_{nL}-MinRGB_{nL}$, and the value of the signal for the blue color sub-pixel is $B_{nL}-MinRGB_{nL}$, and in a case, where $MinRGB_{nL}>TH_1$ holds, the signal generation unit generates a signal for each sub-pixel such that:

the value of the signal for the white color sub-pixel is 1, the value of the signal for the red color sub-pixel is $(R_{nL}-TH_1)/(1-TH_1)$, the value of the signal for the green color sub-pixel is $(G_{nL}-TH_1)/(1-TH_1)$, and the value of the signal for the blue color sub-pixel is $(B_{nL}-TH_1)/(1-TH_1)$.

[6]

The driving method of the image display apparatus according to the above [5], wherein a maximum brightness of white color display in design that can be displayed by the red color sub-pixel, the green color sub-pixel, and the blue color sub-pixel in a single pixel is denoted as $W_{R+G+B_max}$, and a maximum brightness of white color display in design that can be displayed by the white color sub-pixel in a single pixel is denoted as $W_{W_max}$, and in this case the value of the threshold $TH_1$ is set to a value given by $W_{W_max}/(W_{R+G+B_max}+W_{W_max})$.

[7]

The driving method of the image display apparatus according to the above [5] or [6], wherein the image display unit is a reflection-type.

[8]

The driving method of the image display apparatus according to the above [5] or [6], wherein the image display unit is a transmission-type.

[9]

A signal generation program executed by a signal generation apparatus which generates a signal for a red color sub-pixel, a signal for a green color sub-pixel, a signal for a blue color sub-pixel, and a signal for the white color sub-pixel on the basis of an image signal for red color display, an image signal for green color display, and an image signal for blue color display which are provided according to an image to be displayed, wherein the image signal for red color display, the image signal for green color display, and the image signal for blue color display which are linearized and normalized and which correspond to a pixel are denoted as reference symbol $R_{nL}$, reference symbol $G_{nL}$, reference symbol $B_{nL}$, respectively, a minimum value thereof is denoted as $MinRGB_{nL}$, and a threshold defined as a predetermined value is denoted as reference symbol $TH_1$ (however, $0<TH_1<1$), in a case, where $MinRGB_{nL} \leq TH_1$ holds, the signal generation apparatus generates a signal for each sub-pixel such that:

the value of the signal for the white color sub-pixel is $MinRGB_{nL}/TH_1$, the value of the signal for the red color sub-pixel is $R_{nL}-MinRGB_{nL}$, the value of the signal for the green color sub-pixel is $G_{nL}-MinRGB_{nL}$, and the value of the signal for the blue color sub-pixel is $B_{nL}-MinRGB_{nL}$, and in a case, where $MinRGB_{nL}>TH_1$ holds, the signal generation apparatus generates a signal for each sub-pixel such that:

the value of the signal for the white color sub-pixel is 1, the value of the signal for the red color sub-pixel is $(R_{nL}-TH_1)/(1-TH_1)$, the value of the signal for the green color sub-pixel is $(G_{nL}-TH_1)/(1-TH_1)$, and the value of the signal for the blue color sub-pixel is $(B_{nL}-TH_1)/(1-TH_1)$.

[10]

The signal generation program according to the above [9], wherein a maximum brightness of white color display in design that can be displayed by the red color sub-pixel, the green color sub-pixel, and the blue color sub-pixel in a single pixel is denoted as $W_{R+G+B_max}$, and a maximum brightness of white color display in design that can be displayed by the white color sub-pixel in a single pixel is denoted as $W_{W_max}$, and in this case the value of the threshold $TH_1$ is set to a value given by $W_{W_max}/(W_{R+G+B_max}+W_{W_max})$.

[11]

A signal generation apparatus which generates a signal for the a color sub-pixel, a signal for a green color sub-pixel, a signal for a blue color sub-pixel, and a signal for a white color sub-pixel on the basis of an image signal for red color display, an image signal for green color display, and an image signal for blue color display which are provided according to an image to be displayed, wherein the image signal for red color display, the image signal for green color display, and the image signal for blue color display which are linearized and normalized and which correspond to a pixel are denoted as reference symbol $R_{nL}$, reference symbol $G_{nL}$, reference symbol $B_{nL}$, respectively, a minimum value thereof is denoted as $MinRGB_{nL}$, and a threshold defined as a predetermined value is denoted as reference symbol $TH_1$ (however, $0<TH_1<1$), in a case, where $MinRGB_{nL}\leq TH_1$ holds, the signal generation apparatus generates a signal for each sub-pixel such that:

the value of the signal for the white color sub-pixel is $MinRGB_{nL}/TH_1$, the value of the signal for the red color sub-pixel is $R_{nL}-MinRGB_{nL}$, the value of the signal for the green color sub-pixel is $G_{nL}-MinRGB_{nL}$, and the value of the signal for the blue color sub-pixel is $B_{nL}-MinRGB_{nL}$, and in a case, where $MinRGB_{nL}>TH_1$ holds, the signal generation apparatus generates a signal for each sub-pixel such that:

the value of the signal for the white color sub-pixel is 1, the value of the signal for the red color sub-pixel is $(R_{nL}-TH_1)/(1-TH_1)$, the value of the signal for the green color sub-pixel is $(G_{nL}-TH_1)/(1-TH_1)$, and the value of the signal for the blue color sub-pixel is $(B_{nL}-TH_1)/(1-TH_1)$.

[12]

The signal generation apparatus according to the above [11], wherein a maximum brightness of white color display in design that can be displayed by the red color sub-pixel, the green color sub-pixel, and the blue color sub-pixel in a single pixel is denoted as $W_{R+G+B_max}$, and a maximum brightness of white color display in design that can be displayed by the white color sub-pixel in a single pixel is denoted as $W_{W_max}$, and in this case the value of the threshold $TH_1$ is set to a value given by $W_{W_max}/(W_{R+G+B_max}+W_{W_max})$.

[13]

A signal generation method which generates a signal for a red color sub-pixel, a signal for a green color sub-pixel, a signal for a blue color sub-pixel, and a signal for a white color sub-pixel on the basis of an image signal for red color display, an image signal for green color display, and an image signal for blue color display which are provided according to an image to be displayed, wherein the image signal for red color display, the image signal for green color display, and the image signal for blue color display which are linearized and normalized and which correspond to a pixel are denoted as reference symbol $R_{nL}$, reference symbol $G_{nL}$, reference symbol $B_{nL}$, respectively, a minimum value thereof is denoted as $MinRGB_{nL}$, and a threshold defined as a predetermined value is denoted as reference symbol $TH_1$ (however, $0<TH_1<1$), in a case, where $MinRGB_{nL}\leq TH_1$ holds, a signal for each sub-pixel is generated such that:

the value of the signal for the white color sub-pixel is $MinRGB_{nL}/TH_1$, the value of the signal for the red color sub-pixel is $R_{nL}-MinRGB_{nL}$, the value of the signal for the green color sub-pixel is $G_{nL}-MinRGB_{nL}$, and the value of the signal for the blue color sub-pixel is $B_{nL}-MinRGB_{nL}$, and in a case, where $MinRGB_{nL}>TH_1$ holds, a signal for each sub-pixel is generated such that:

the value of the signal for the white color sub-pixel is 1, the value of the signal for the red color sub-pixel is $(R_{nL}-TH_1)/(1-TH_1)$, the value of the signal for the green color sub-pixel is $(G_{nL}-TH_1)/(1-TH_1)$, and the value of the signal for the blue color sub-pixel is $(B_{nL}-TH_1)/(1-TH_1)$.

[14]

The signal generation method according to the above [13], wherein a maximum brightness of white color display in design that can be displayed by the red color sub-pixel, the green color sub-pixel, and the blue color sub-pixel in a single pixel is denoted as $W_{R+G+B_max}$, and a maximum brightness of white color display in design that can be displayed by the white color sub-pixel in a single pixel is denoted as $W_{W_max}$, and in this case the value of the threshold $TH_1$ is set to a value given by $W_{W_max}/(W_{R+G+B_max}+W_{W_max})$.

REFERENCE SIGNS LIST

1 . . . Image display apparatus,

10 . . . Linearization and normalization unit,

20 . . . Signal generation unit (signal generation apparatus),

30 . . . Non-linearization and quantization unit,

40 . . . Image display unit,

41 . . . Display area,

42, 42' . . . Pixel, $\mathbf{42}_W$ . . . White color sub-pixel, $\mathbf{42}_R$, $\mathbf{42}_R'$ . . . Red color sub-pixel, $\mathbf{42}_G$, $\mathbf{42}_G'$ . . . Green color sub-pixel, $\mathbf{42}_B$, $\mathbf{42}_B'$ . . . Blue color sub-pixel, $R_{sRGB}$, $G_{sRGB}$, $B_{sRGB}$ . . . Image signals of sRGB specification, $R_{nL}$, $G_{nL}$, $B_{nL}$ . . . Linearized and normalized image signal, $R_{cvt}$, $G_{cvt}$, $B_{cvt}$, $W_{cvt}$ . . . Converted signals for each sub-pixel, $R_{out}$, $G_{out}$, $B_{out}$, $W_{out}$ . . . Non-linearization and quantized signals

The invention claimed is:

1. An image display apparatus, comprising:

an image display unit in which pixels constituted by a red color sub-pixel, a green color sub-pixel, a blue color sub-pixel, and a white color sub-pixel are arranged in a two-dimensional matrix manner; and a signal generation unit configured to generate a signal for the red color sub-pixel, a signal for the green color sub-pixel, a signal for the blue color sub-pixel, and a signal for the white color sub-pixel on the basis of an image signal for red color display, an image signal for green color display, and an image signal for blue color display which are provided according to an image to be displayed, wherein the image signal for red color display, the image signal for green color display, and the image signal for blue color display which are linearized and normalized and which correspond to a pixel are denoted as reference symbol $R_{nL}$, reference symbol $G_{nL}$, reference symbol $B_{nL}$, respectively, a minimum value thereof is denoted as $MinRGB_{nL}$, and a threshold defined is denoted as reference symbol $TH_1$, wherein $0<TH_1<1$, in a case, where $MinRGB_{nL} \leq TH_1$ holds, the signal generation unit is configured to generate a signal for each sub-pixel such that:

the value of the signal for the white color sub-pixel is $MinRGB_{nL}/TH_1$, the value of the signal for the red color sub-pixel is $R_{nL}-MinRGB_{nL}$, the value of the signal for the green color sub-pixel is $G_{nL}-MinRGB_{nL}$, and the value of the signal for the blue color sub-pixel is $B_{nL}-MinRGB_{nL}$, and in a case, where $MinRGB_{nL}>TH_1$ holds, the signal generation unit is configured to generate a signal for each sub-pixel such that:

the value of the signal for the white color sub-pixel is 1, the value of the signal for the red color sub-pixel is $(R_{nL}-TH_1)/(1-TH_1)$, the value of the signal for the green color sub-pixel is $(G_{nL}-TH_1)/(1-TH_1)$, and the value of the signal for the blue color sub-pixel is $(B_{nL}-TH_1)/(1-TH_1)$.

2. The image display apparatus according to claim 1, wherein a maximum brightness of white color display in design to be displayed by the red color sub-pixel, the green color sub-pixel, and the blue color sub-pixel in a single pixel is denoted as $W_{R+G+B_max}$, and a maximum brightness of the white color display in the design to be displayed by the white color sub-pixel in the single pixel is denoted as $W_{W_max}$, and the value of the threshold $TH_1$ is set to a value given by $W_{W_max}/(W_{R+G+B_max}+W_{W_max})$.

3. The image display apparatus according to claim 1, wherein the image display unit is a reflection-type.

4. The image display apparatus according to claim 1, wherein the image display unit is a transmission-type.

5. A driving method of an image display apparatus, comprising:

constituting pixels by arranging a red color sub-pixel, a green color sub-pixel, a blue color sub-pixel, and a white color sub-pixel in a two-dimensional matrix manner; and generating a signal for the red color sub-pixel, a signal for the green color sub-pixel, a signal for the blue color sub-pixel, and a signal for the white color sub-pixel on the basis of an image signal for red color display, an image signal for green color display, and an image signal for blue color display which are provided according to an image to be displayed, wherein the image signal for red color display, the image signal for green color display, and the image signal for blue color display which are linearized and normalized and which correspond to a pixel are denoted as reference symbol $R_{nL}$, reference symbol $G_{nL}$, reference symbol $B_{nL}$, respectively, a minimum value thereof is denoted as $MinRGB_{nL}$, and a threshold is denoted as reference symbol $TH_1$, wherein $0<TH_1<1$, in a case, where $MinRGB_{nL}$ $TH_1$ holds, generating a signal for each sub-pixel such that:

the value of the signal for the white color sub-pixel is $MinRGB_{nL}/TH_1$, the value of the signal for the red color sub-pixel is $R_{nL}-MinRGB_{nL}$, the value of the signal for the green color sub-pixel is $G_{nL}-MinRGB_{nL}$, and the value of the signal for the blue color sub-pixel is $B_{nL}-MinRGB_{nL}$, and in a case, where $MinRGB_{nL}>TH_1$ holds, generating a signal for each sub-pixel such that:

the value of the signal for the white color sub-pixel is 1, the value of the signal for the red color sub-pixel is $(R_{nL}-TH_1)/(1-TH_1)$, the value of the signal for the green color sub-pixel is $(G_{nL}-TH_1)/(1-TH_1)$, and the value of the signal for the blue color sub-pixel is $(B_{nL}-TH_1)/(1-TH_1)$.

6. A non-transitory computer-readable storage medium having stored thereon, a set of instructions, which when executed, causes a signal generation apparatus to execute operations, comprising:

generating a signal for a red color sub-pixel, a signal for a green color sub-pixel, a signal for a blue color sub-pixel, and a signal for a white color sub-pixel on the basis of an image signal for red color display, an image signal for green color display, and an image signal for blue color display which are provided according to an image to be displayed, wherein the image signal for red color display, the image signal for green color display, and the image signal for blue color display which are linearized and normalized and which correspond to a pixel are denoted as reference symbol $R_{nL}$, reference symbol $G_{nL}$, reference symbol $B_{nL}$, respectively, a minimum value thereof is denoted as $MinRGB_{nL}$, and a threshold is denoted as reference symbol $TH_1$, wherein $0<TH_1<1$, in a case, where $MinRGB_{nL} \leq TH_1$ holds, generating a signal for each sub-pixel such that:

the value of the signal for the white color sub-pixel is $MinRGB_{nL}/TH_1$, the value of the signal for the red color sub-pixel is $R_{nL}-MinRGB_{nL}$, the value of the signal for the green color sub-pixel is $G_{nL}-MinRGB_{nL}$, and the value of the signal for the blue color sub-pixel is $B_{nL}-MinRGB_{nL}$, and in a case, where $MinRGB_{nL}>TH_1$ holds, generating a signal for each sub-pixel such that:

the value of the signal for the white color sub-pixel is 1, the value of the signal for the red color sub-pixel is $(R_{nL}-TH_1)/(1-TH_1)$, the value of the signal for the green color sub-pixel is $(G_{nL}-TH_1)/(1-TH_1)$, and the value of the signal for the blue color sub-pixel is $(B_{nL}-TH_1)/(1-TH_1)$.

7. A signal generation apparatus configured to:

generate a signal for a red color sub-pixel, a signal for a green color sub-pixel, a signal for a blue color sub-pixel, and a signal for a white color sub-pixel on the basis of an image signal for red color display, an image signal for green color display, and an image signal for blue color display which are provided according to an image to be displayed, wherein the image signal for red color display, the image signal for green color display, and the image signal for blue color display which are linearized and normalized and which correspond to a pixel are denoted as reference symbol $R_{nL}$, reference symbol $G_{nL}$, reference symbol $B_{nL}$, respectively, a minimum value thereof is denoted as $MinRGB_{nL}$, and a threshold is denoted as reference symbol $TH_1$, wherein $0<TH_1<1$, in a case, where $MinRGB_{nL} \leq TH_1$ holds, the signal generation apparatus is configured to generate a signal for each sub-pixel such that:

the value of the signal for the white color sub-pixel is $MinRGB_{nL}/TH_1$, the value of the signal for the red color sub-pixel is $R_{nL}-MinRGB_{nL}$, the value of the signal for the green color sub-pixel is $G_{nL}-MinRGB_{nL}$, and the value of the signal for the blue color sub-pixel is $B_{nL}-MinRGB_{nL}$, and in a case, where $MinRGB_{nL}>TH_1$ holds, the signal generation apparatus is configured to generate a signal for each sub-pixel such that:

the value of the signal for the white color sub-pixel is 1, the value of the signal for the red color sub-pixel is $(R_{nL}-TH_1)/(1-TH_1)$, the value of the signal for the green color sub-pixel is $(G_{nL}-TH_1)/(1-TH_1)$, and the value of the signal for the blue color sub-pixel is $(B_{nL}-TH_1)/(1-TH_1)$.

8. A signal generation method, comprising:

generating a signal for a red color sub-pixel, a signal for a green color sub-pixel, a signal for a blue color sub-pixel, and a signal for a white color sub-pixel on the basis of an image signal for red color display, an image signal for green color display, and an image signal for blue color display which are provided according to an image to be displayed, wherein the image signal for red color display, the image signal for green color display, and the image signal for blue color display which are linearized and normalized and which correspond to a pixel are denoted as reference symbol $R_{nL}$, reference symbol $G_{nL}$, reference symbol $B_{nL}$, respectively, a minimum value thereof is denoted as $MinRGB_{nL}$, and a threshold value is denoted as reference symbol $TH_1$, wherein $0<TH_1<1$, in a case, where $MinRGB_{nL} \leq TH_1$ holds, generating a signal for each sub-pixel such that:

the value of the signal for the white color sub-pixel is $MinRGB_{nL}/TH_1$, the value of the signal for the red color sub-pixel is $R_{nL}-MinRGB_{nL}$, the value of the signal for the green color sub-pixel is $G_{nL}-MinRGB_{nL}$, and the value of the signal for the blue color sub-pixel is $B_{nL}-MinRGB_{nL}$, and in a case, where $MinRGB_{nL}>TH_1$ holds, generating a signal for each sub-pixel such that:

the value of the signal for the white color sub-pixel is 1, the value of the signal for the red color sub-pixel is $(R_{nL}-TH_1)/(1-TH_1)$, the value of the signal for the green color sub-pixel is $(G_{nL}-TH_1)/(1-TH_1)$, and the value of the signal for the blue color sub-pixel is $(B_{nL}-TH_1)/(1-TH_1)$.

* * * * *